US011447370B2

(12) United States Patent
Lanz et al.

(10) Patent No.: US 11,447,370 B2
(45) Date of Patent: Sep. 20, 2022

(54) METHOD FOR CONSTRUCTING ELEVATOR

(71) Applicant: Kone Corporation, Helsinki (FI)

(72) Inventors: Otto Lanz, Helsinki (FI); Matti Rasanen, Helsinki (FI); Anssi Venho, Helsinki (FI); Markku Haapaniemi, Helsinki (FI); Janne Mikkonen, Helsinki (FI); Janne Laine, Helsinki (FI); Tarvo Viita-Aho, Helsinki (FI); Markku Haivala, Helsinki (FI); Jukka Laitinen, Helsinki (FI); Hans Valtonen, Helsinki (FI); Aki Haikonen, Helsinki (FI); Jorma Mustalahti, Helsinki (FI); Jori Hagg, Helsinki (FI); Jari Osterman, Helsinki (FI); Petri Kere, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 17/147,616

(22) Filed: Jan. 13, 2021

(65) Prior Publication Data

US 2021/0245998 A1 Aug. 12, 2021

(30) Foreign Application Priority Data

Feb. 12, 2020 (EP) ..... 20156935

(51) Int. Cl.
*B66B 19/00* (2006.01)
*B66B 9/00* (2006.01)
*B66B 19/02* (2006.01)

(52) U.S. Cl.
CPC ..... *B66B 19/007* (2013.01); *B66B 9/00* (2013.01); *B66B 19/002* (2013.01); *B66B 19/005* (2013.01); *B66B 19/02* (2013.01)

(58) Field of Classification Search
CPC ... B66B 19/002; B66B 19/005; B66B 19/007; B66B 19/00
See application file for complete search history.

(56) References Cited

U.S. PATENT DOCUMENTS 3,851,736 A * 12/1974 Westlake ..... B66B 19/002 52/30
9,604,820 B2 * 3/2017 De Jong ..... B66B 19/002
2010/0133048 A1 * 6/2010 Barneman ..... B66B 19/00 187/414

FOREIGN PATENT DOCUMENTS

EP 2636629 A1 * 9/2013 ..... B66B 19/00
JP 2013216483 A 10/2013
(Continued)

OTHER PUBLICATIONS

Extended European Search Report, dated Aug. 24, 2020.

*Primary Examiner* — Diem M Tran
(74) *Attorney, Agent, or Firm* — Harness, Dickey & Pierce, P.L.C.

(57) ABSTRACT

The invention relates to a method for constructing an elevator comprising constructing a movable machine room in the bottom end of a hoistway formed in a building under construction; and thereafter hoisting the movable machine room; and constructing an elevator car in the bottom end of the hoistway below the movable machine room; and providing a counterweight in the bottom end of the hoistway below the movable machine room; connecting the elevator car and the counterweight with a suspension roping; and thereafter hoisting the movable machine room to a first transport position; and thereafter mounting the movable machine room to the first transport position in the hoistway vertically supported on stationary structures; and thereafter using the elevator car for transporting passengers and/or goods below the movable machine room while the machine
(Continued)

room is mounted in said first transport position and the elevator car and the counterweight hang suspended from the machine room by the hoisting roping; and thereafter hoisting the movable machine room upwards to a second transport position; wherein the second transport position is higher than said first transport position; and thereafter mounting the movable machine room to the second transport position in the hoistway vertically supported on stationary structures; and thereafter using the elevator car for transporting passengers and/or goods below the movable machine room while the movable machine room is mounted in said second position.

15 Claims, 6 Drawing Sheets

(56) References Cited

FOREIGN PATENT DOCUMENTS

| | | | | | |
|---|---|---|---|---|---|
| WO | WO-2004/050526 | A1 | 6/2004 | | |
| WO | WO-2011080387 | A1 | 7/2011 | | |
| WO | WO-2015003964 | A1 * | 1/2015 | ..... | B66B 19/00 |
| WO | WO-2017102684 | A1 * | 6/2017 | ..... | B66B 19/00 |

* cited by examiner

METHOD FOR CONSTRUCTING ELEVATOR

RELATED APPLICATIONS

This application claims priority to European Patent Application No. EP 20156935.7, filed on Feb. 12, 2020, the entire contents of which are incorporated herein by reference.

FIELD OF THE INVENTION

The invention relates to a method for constructing an elevator, in particular to a method wherein the elevator can be used for transportation already during the construction thereof. The elevator is preferably an elevator for transporting passengers and/or goods.

BACKGROUND OF THE INVENTION

In connection with so-called jump-lifts, the bottom part of an elevator hoistway is taken into use before the building has been completed. In this case the upper parts of the building as well as the top part of the elevator hoistway can be constructed at the same time as an elevator moving in the bottom part of the elevator hoistway already serves people on the lower floors of the building under construction. Typically in jump-lifts the elevator car moving in the lower parts of the elevator hoistway is supported and moved during construction-time use with a hoisting machine supported on a machine room which is vertically movable in the elevator hoistway.

The car can hangs suspended from the movable machine room during its use for transporting passengers and/or goods below the movable machine room via a hoisting roping.

Typically, the movable machine room has been lifted as a complete unit into the hoistway, and mounted at a certain height therein. Construction work in the hoistway above the vertically movable machine room has been performed by working on an installation platform suspended from above, or alternatively by working on scaffolds mounted in the hoistway.

When the elevator hoistway under construction above the vertically movable machine room has reached a sufficient stage of completion, the completed part of the elevator hoistway can be taken into use. At this stage a "jump" is performed, wherein the vertically movable machine room is hoisted higher in the elevator hoistway. Thereafter, the car can reach a higher position than before the jump and start to serve additional floors.

In prior art, a drawback has been that installing the parts of the jump lift that are to be located a height above the car has been slow and complicated. Often this has required lifting of large parts, such as the movable machine room and/or an installation platform, into the hoistway using construction site crane, which is often needed for other tasks and may not be swiftly available.

BRIEF DESCRIPTION OF THE INVENTION

The object of the invention is to introduce an improved method for constructing an elevator. An object is particularly to introduce a solution by which one or more of the above defined problems of prior art and/or drawbacks discussed or implied elsewhere in the description can be solved. An object is particularly to make swift and simple to install the parts of the jump lift.

It is brought forward embodiments particularly by which dependence of a building site crane can be reduced.

It is brought forward embodiments particularly by which installation of a machine room of a jump elevator to a transport position can be made swift and efficient.

It is brought forward embodiments particularly by which installation of parts of a jump elevator that are located above a machine room can be made swift and efficient.

It is brought forward a new method for constructing an elevator comprising constructing a movable machine room in the bottom end of a hoistway formed in a building under construction; and thereafter hoisting the movable machine room; and preferably mounting the movable machine room to a hoisted position in the hoistway vertically supported on stationary structures; and constructing an elevator car in the bottom end of the hoistway below the movable machine room; and providing a counterweight in the bottom end of the hoistway below the movable machine room; and connecting the elevator car and the counterweight with a suspension roping preferably hanging from the movable machine room and passing around at least one rope wheel of the movable machine room; and thereafter hoisting the movable machine room to a first transport position (I); and thereafter mounting the movable machine room to the first transport position in the hoistway vertically supported on stationary structures; and thereafter using the elevator car for transporting passengers and/or goods below the movable machine room while the machine room is mounted in said first transport position (I), and in particular while the elevator car and the counterweight hang suspended from the machine room by the hoisting roping; and thereafter hoisting the movable machine room upwards to a second transport position (II); wherein the second transport position (II) is higher than said first transport position (I); and thereafter mounting the movable machine room to the second transport position (II) in the hoistway vertically supported on stationary structures; and thereafter using the elevator car for transporting passengers and/or goods below the movable machine room while the movable machine room is mounted in said second position (II), and in particular while the elevator car and the counterweight hang suspended from the machine room by the hoisting roping.

With this kind of solution one or more of the above mentioned objects can be achieved. This solution inter alia reduces dependence a building site crane as well as makes initial steps of a method for constructing an elevator swift and efficient.

Preferable further details of the method are introduced in the following, which further details can be combined with the method individually or in any combination.

In a preferred embodiment, in said constructing a movable machine room, the movable machine room is constructed in the bottom end of a hoistway to rest supported by the floor of the hoistway. Thus, the movable machine room can be constructed in a place where installation work can be performed safely and with minimal need of a building site crane.

In a preferred embodiment, in said constructing an elevator car the elevator car is constructed above a buffer; and/or the elevator car is constructed to lean laterally on one or more guide rail lines; and/or structural parts of the elevator car are installed on a car frame while it is suspended from the machine room, in particular by an auxiliary hoist.

In a preferred embodiment, said constructing a movable machine room comprises transporting into the bottom end of the hoistway plurality of prefabricated sub modules, and connecting the plurality of prefabricated sub modules to each other in the bottom end of the hoistway. This makes construction work of the movable machine room swift, accurate and simple to be performed inside the hoistway (instead of a factory for instance). This also makes it simple to later disassemble the movable machine room so as to use parts thereof to construct a movable machine room in a bottom end of another hoistway.

In a preferred embodiment, the method comprises after at least one step of using the elevator car for transporting passengers and/or goods, disassembling the movable machine room, the disassembling preferably comprising disconnecting one or more of the sub-modules of the machine room, and constructing a movable machine room in a bottom end of another hoistway, such as a hoistway formed in a different building under construction, using parts from the disassembled machine room, preferably said one or more sub-module from the disassembled machine room.

In a preferred embodiment, said constructing a movable machine room in a bottom end of another hoistway comprises transporting into the bottom end plurality of prefabricated sub modules from the disassembled machine room.

In a preferred embodiment, said movable machine room comprises a support platform of a hoisting machine, the support platform comprising one or more releasable mounting mechanisms for releasably mounting the moveable machine room in the hoistway; and a hoisting machine mounted on the support platform;

a working platform on top of the support platform, preferably also forming a roof of the moveable machine room and/or comprising handrails; and at least one support structure supported by which the working platform rests on the support platform or at least can rest on the support platform.

In a preferred embodiment, said support structure is selectively actuatable to expand in vertical direction for hoisting the working platform higher above the support platform, in particular taking reaction force from the support platform, or to contract in vertical direction for lowering the working platform back towards the support platform. Hereby, back and forth movement is achieved and working can be performed above the support platform at different heights. It is also enabled that working can be performed relatively high above the support platform and thereafter the working platform lowered back towards the support platform so that the movable machine room becomes compact again and relatively easy and rigid to hoist vertically to a higher position in the hoistway. This makes the method simple and swift as well as reduces dependency on availability of a building site crane or other hoisting arrangements.

In a preferred embodiment, the method comprises while the movable machine room is (in particular in a mounted state) in a transport position (I or II) in the hoistway, using the working platform for installing elevator components from the working platform in the parts of the hoistway above the support platform. Said using preferably comprises moving the working platform up and down with the aforementioned selectively actuatable support structure.

In a preferred embodiment, the aforementioned using the working platform comprises one or more times actuating the aforementioned selectively actuatable at least one support structure to expand in vertical direction for hoisting the working platform higher above the support platform; and one or more times actuating the at least one support structure to contract in vertical direction for lowering the working platform back towards the support platform. Said using preferably comprises operating an operating interface, which is preferably connected to each selectively actuatable support structure of the movable machine room, in particular to the actuating means of each selectively actuatable support structure of the movable machine room. Thereby operation of the actuation is facilitated. Also, simultaneous actuation is possible when plurality of actuating means are present.

In a preferred embodiment, an operating interface is connected to each selectively actuatable support structure of the movable machine room, in particular to the actuating means of each selectively actuatable support structure of the movable machine room. The interface can be in the form of an operating panel such as a push button panel or a touch screen, for instance.

In a preferred embodiment, the aforementioned selectively actuatable support structure comprises an upright mast selectively actuatable to expand or contract in vertical direction.

In a preferred embodiment, said upright mast comprises plurality of parallel elongated mast members movable along each other.

In a preferred embodiment, said elongated mast members are vertically oriented beams and the support structure comprises an actuating means for moving them along each other for expanding the mast or contracting the mast.

In a preferred embodiment, said elongated mast members comprise a hydraulic piston and a cylinder hydraulically selectively actuatable to expand or contract.

In a preferred embodiment, the aforementioned selectively actuatable support structure comprises a scissor jack mechanism selectively actuatable to expand or contract in vertical direction.

In a preferred embodiment, said plurality of prefabricated sub modules comprises a first prefabricated sub module comprising a support platform of a hoisting machine, the support platform comprising one or more releasable mounting mechanisms for releasably mounting the moveable machine room in the hoistway, possibly also a premounted hoisting machine; and/or a second prefabricated sub module comprising a working platform forming a roof of the moveable machine room and comprising handrails; and/or at least one third prefabricated sub module suitable for being mounted between the first and second module for coupling these to each other.

In a preferred embodiment, said at least one third prefabricated sub module comprises a support structure supported by which the working platform of the second prefabricated sub module rests on the support platform or at least can rest on the support platform.

In a preferred embodiment, the method comprises mounting vertical guide rail lines in the hoistway for guiding movement of the elevator car and/or the movable machine room.

In a preferred embodiment, the movable machine room, in particular the first prefabricated sub module and/or the second prefabricated sub module, comprises a guide for guiding vertical movement of the movable machine room along a vertical guide rail line of the elevator car.

In a preferred embodiment, in said hoisting of the movable machine room, the movable machine room is hoisted with a hoisting arrangement taking support from a support structure mounted in the hoistway above the movable machine room.

A method according to any of the preceding claims, comprising before said (first) using providing an elevator control system for automatically controlling movement of the elevator car, in particular in response to call signals received.

In a preferred embodiment, each said using elevator car for transporting passengers and/or goods comprises receiving call signals from one or more user interfaces, in particular from one or more user interfaces located at floors and/or in the elevator car and/or mobile user interfaces, and moving the elevator car in response to said call signals automatically controlled by an elevator control system.

In a preferred embodiment, said support structure is selectively actuatable to expand at least 2 meters in vertical direction for hoisting the working platform at least 2 meters. The distance being substantially long is, for instance, enough in many sites to allow moving of the working platform vertically to be positioned from being near to one landing to near another landing, which allows easy installation of landing door components and/or access to/from the working platform. Likewise, the distance being substantially long is, for instance, enough in many sites to allow moving of the working platform vertically to be positioned from being near to one bracket position to near another bracket position.

In a preferred embodiment, said support structure is not actuated during hoisting of the movable machine room upwards to a transport position (I or II).

In a preferred embodiment, before hoisting of the movable machine room upwards to a transport position (I or II) said support structure is in locked from being expandable. Hereby, accidental expansion during said hoisting is blocked.

In a preferred embodiment, each said mounting of the movable machine room is performed with at least one releasable mounting mechanism.

In a preferred embodiment, the releasable mounting mechanism is shiftable between a first state and a second state, wherein said first state said mechanism engages a stationary structure to take support from it, and in said second state said mechanism is released from said engagement.

In a preferred embodiment, the stationary structure preferably being a hoistway wall, floor sill, a bracket by which a guide rail section of a rail line has been fixed to hoistway or a bracket fixed on a rail line e.g. for the purpose of supporting said movable machine room, or a guide rail section of a guider rail line.

In a preferred embodiment, the releasable mounting mechanism comprises an arm which is movable to a first state where it vertically overlaps a bracket fixed stationary in hoistway, and back to a second state where it does not overlap said bracket so that it can bypass a bracket positioned above the aforementioned bracket when being hoisted together with the movable machine room.

In a preferred embodiment, the releasable mounting mechanism comprises an arm which is movable to be on top of a structure of a floor sill or the hoistway wall, such as (in the latter case) on top of a surface of a pocket formed in the wall of the hoistway or a beam, for example, and back away from being on top of said structure of a floor sill or the hoistway wall.

In a preferred embodiment, each said releasable mounting mechanism comprises a gripper suitable for releasably gripping a guide rail section of a guide rail.

In a preferred embodiment, the aforementioned stationary structures include one or more of: a hoistway wall, a floor sill, a bracket by which a guide rail section of a rail line has been fixed to hoistway, a bracket fixed on a rail line e.g. for the purpose of supporting said movable machine room, a guide rail section of a guide rail line.

In a preferred embodiment, the method comprises providing actuating means for selectively actuating said support structure.

In a preferred embodiment, during each hoisting of the movable machine room, vertical movement of the movable machine room is guided by one or more guides comprised in the movable machine room which one or more guides run along one or more guide rail lines.

In a preferred embodiment, when the movable machine room is mounted in said first and/or second transport position, the support platform bears the full weight of the working platform via the at least one selectively actuatable support structure.

In a preferred embodiment, the car is constructed to have an interior space suitable for receiving a passenger or passengers, and a door movable between open and closed state for opening and closing the interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
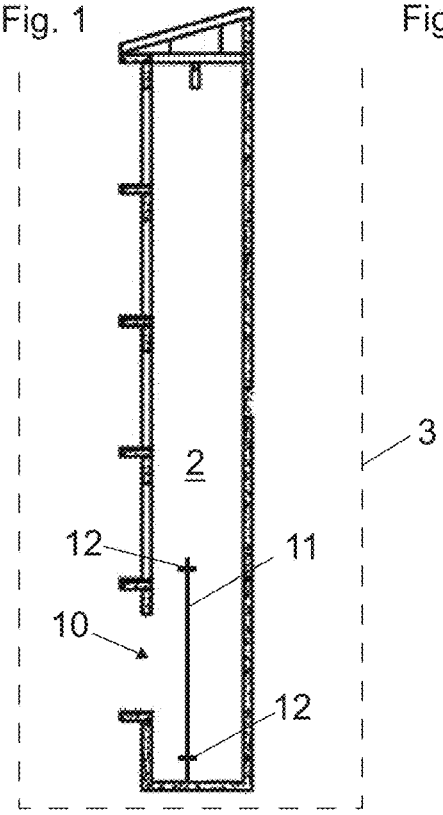
FIGS. 1-12 illustrate phases of a method according to an embodiment.

FIG. 1 illustrates a phase in a method according to an embodiment. The method comprises providing a hoistway 2 in a building (3) under construction and mounting vertical guide rail lines 10 in the hoistway for guiding movement of the elevator car (4) and/or the movable machine room. The guide rail lines 10 are provided by first mounting a lowermost guide rail section 11 immovably into the hoistway 2 with brackets 12, as illustrated in FIG. 1. Later as the method progresses, the guide rail lines 10 are extended gradually to reach higher by repeatedly placing a guide rail section 11 on top of an earlier fixed guide rail section 11 and fixing it with brackets 12 immovably into the hoistway 2.

Figure 2:
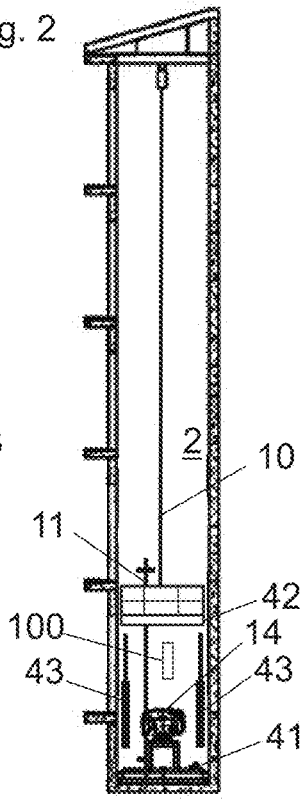
Figure 3:
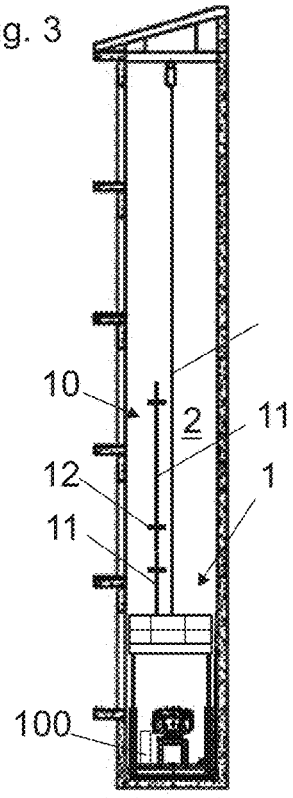

After mounting of the lowermost guide rail section immovably into the hoistway 2, the method comprises constructing a movable machine room 1 in the bottom end of a hoistway 2, as illustrated in FIGS. 2-3. Thus, the movable machine room 1 can be constructed in a place where installation work can be performed safely and without necessity to use of a building site crane.

After said constructing of the movable machine room 1, the method comprises placing a guide rail section 11 on top of an earlier fixed guide rail section 11 and fixing it with brackets 12 immovably into the hoistway 2, as illustrated in FIG. 3. Said placing and fixing can be done working on top of a working platform 420 comprised in the movable machine room 1. For the sake of clarity, FIG. 3 illustrates only one guide rail line 10 which in this view is positioned behind the elevator car 4. Preferably, another guide rail line is positioned on opposite side of the car 4 so that the car is between guide rail lines 10.

Figure 4:
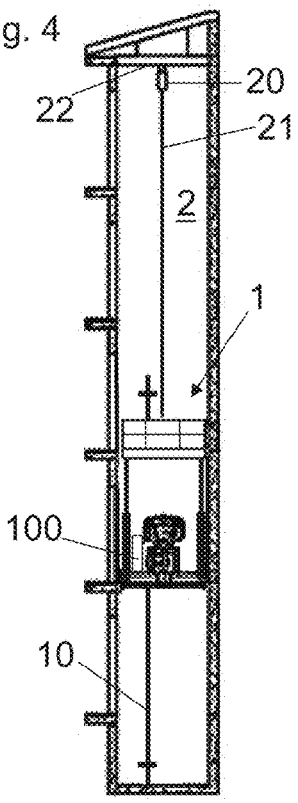

After constructing of the movable machine room 1, the method comprises hoisting the movable machine room 1 into an elevated position as illustrated in FIG. 4. Here, said hoisting is performed with a hoisting arrangement 20,21 taking support from a support structure 22 above the movable machine room 1, which is preferably a support structure mounted in the hoistway 2 such as a cross-beam of a deflection deck located above the movable machine room 1.

After said hoisting, the method comprises mounting the movable machine room to a hoisted position in the hoistway vertically supported on stationary structures. However, this is not necessary since the movable machine room 1 can alternatively be supported temporarily by the hoisting arrangement 20, 21. There are alternatives for the aforementioned stationary structures. Preferably, the aforementioned stationary structures include one or more of: a hoistway wall 2*a*, a floor sill, a bracket by which a guide rail section of a rail line 10 has been fixed to the hoistway 2 or (some other) bracket fixed on a rail line 10 e.g. for the purpose of supporting said movable machine room, or a guide rail section 11 of a guide rail line 10.

Figure 5:
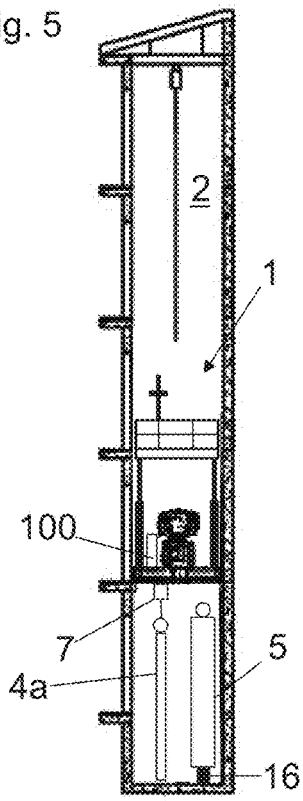
Figure 6:
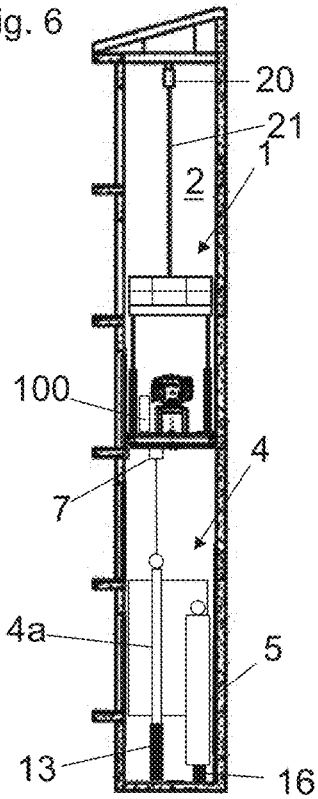

After said hoisting the movable machine room 1, as well as after said mounting if this mounting is included in the method, the method comprises constructing an elevator car 4 in the bottom end of the hoistway 2 below the movable machine room 1, as well as providing a counterweight 5 in the bottom end of the hoistway below the movable machine room, as illustrated in FIGS. 5 and 6. Since the guide rail sections 11 have been mounted, additional space can be made below the movable machine room 1 so that the car 4 and counterweight 5 fit below it. In FIG. 6 this is done by hoisting the movable machine room 1. In said constructing an elevator car 4, preferably the elevator car 4 is constructed above a buffer 13 and to lean laterally on one or more guide rail sections 11. Preferably, structural parts of the elevator car 4 are installed on a car frame 4*a* while the car frame 4*a* is suspended from the machine room 1, in particular by an auxiliary hoist 7. In said providing a counterweight 5, preferably the counterweight 5 is provided above a buffer 16.

Figure 7:
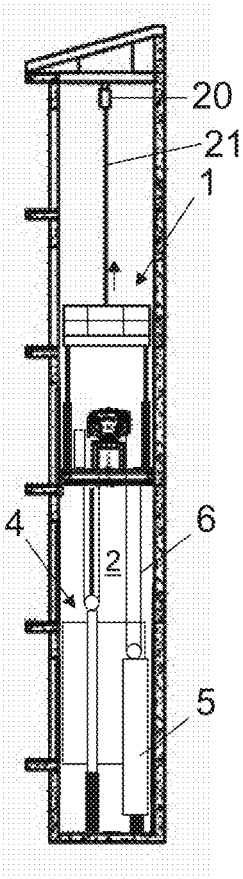
Figure 8:
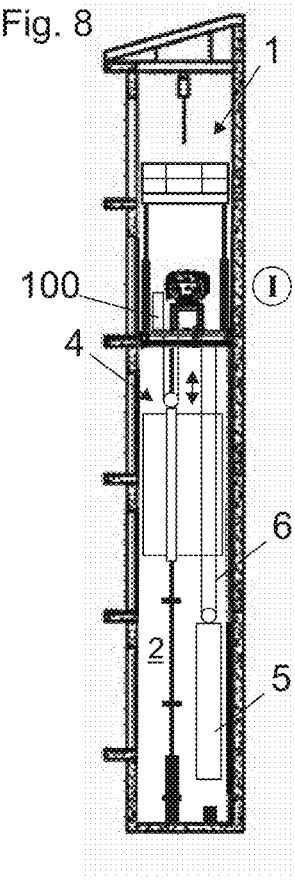
Figure 15:
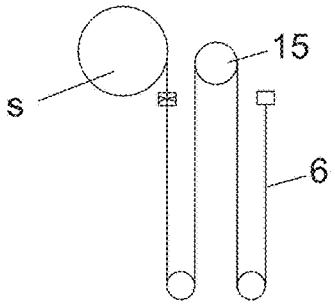
FIG. 15 illustrates preferred details of passage of a roping.

After said constructing an elevator car 4 and providing a counterweight 5 in the bottom end of the hoistway 2 below the movable machine room 1, the method comprises connecting the elevator car 4 and the counterweight 5 with a suspension roping 6 hanging from the movable machine room 1 and passing around at least one rope wheel 15 of the movable machine room 1, in particular a rope wheel of the hoisting machine 14 which is a drive wheel rotatable with a motor also comprised in the hoisting machine 14; and thereafter hoisting the movable machine room 1 to a first transport position I as illustrated in FIGS. 7 and 8. FIG. 15 illustrates preferred details of passage of the roping 6. In this case, one end of the roping 6 is fixed on the movable machine room 1, and from the fixing it passes down and around at least one rope wheel of the counterweight 5, and up to pass over said at least one rope wheel 15, again down and around at least one rope wheel of the car 4 and up to the movable machine room 1, and in particular to a releasable rope clamp, and through it to a rope supply storage in the form of one or more rope reels where the additional rope needed in the method can be taken from. The rope supply storage s can be preferably mounted on the movable machine room 1 but alternatively elsewhere, such as on a landing or in the pit of the hoistway.

After hoisting the movable machine room 1 to a first transport position I, the method comprises mounting the movable machine room 1 to said first transport position I in the hoistway vertically supported on stationary structures. Said mounting is performed using one or more releasable mounting mechanisms 402 comprised in the movable machine room 1. There are alternatives for the aforementioned stationary structures. Preferably, the aforementioned stationary structures include one or more of the following: a hoistway wall 2*a*, floor sill, a bracket by which a guide rail section 11 of a rail line 10 has been fixed to the hoistway 2 or (some other) bracket fixed on a rail line 10 e.g. for the purpose of supporting said movable machine room, or a guide rail section 11 of a guide rail line 10. The preferred alternatives of the mounting mechanism 402 are later explained in further preferred details referring to FIGS. 16-18.

Figure 9:
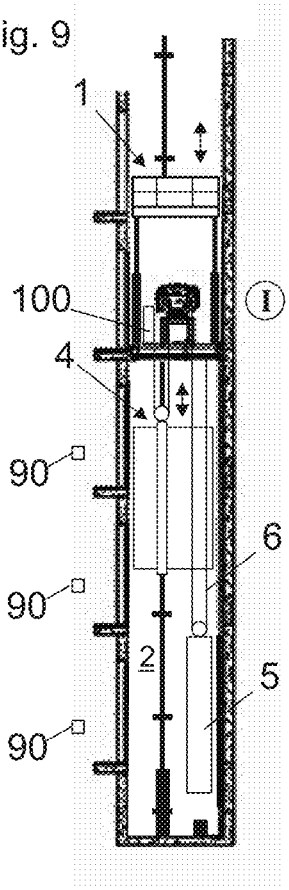

After said mounting, the method comprises using (also referred to as first using) the elevator car 4 for transporting passengers and/or goods below the movable machine room 1 while the machine room 1 is mounted in said first transport position I and the elevator car 4 and the counterweight 5 hang suspended from the machine room 1 by the hoisting roping 6, as illustrated in FIG. 9. In said using the elevator car for transporting passengers and/or goods comprises receiving call signals from one or more user interfaces 90, such as one or more user interfaces 90 located at floors and/or in the elevator car and/or mobile user interfaces, and moving the elevator car in response to said call signals automatically controlled by an elevator control system 100. For this purpose, the method, such as the step constructing a movable machine room 1, comprises before said (first) using providing an elevator control system 100 for automatically controlling movement of the elevator car 4, in particular by automatically operating the machinery 14.

Also after said mounting, preferably at least partially during said first using, the method comprises placing a guide rail section 11 on top of an earlier fixed guide rail section 11 of a guide rail line 10 and fixing it with brackets 12 immovably into the hoistway 2, as illustrated in FIG. 9. Hereby, the guide rail line(s) 10 can be constructed to extend higher during transport use of the elevator. Said placing and fixing can be done working on top of a working platform 420 comprised in the movable machine room 1. This work may involve moving the working platform 420 up and down as will be further described later on.

After said using first using, the method comprises hoisting the movable machine room 1 upwards to a second transport position II; wherein the second transport position II is higher than said first transport position I; and thereafter mounting the movable machine room 1 to the second transport position II in the hoistway 2 vertically supported on stationary structures. Said mounting is performed using one or more releasable mounting mechanisms 402 comprised in the movable machine room 1. There are alternatives for the aforementioned stationary structures. Preferably, the aforementioned stationary structures include one or more of the following: a hoistway wall 2*a*, floor sill, a bracket by which a guide rail section 11 of a rail line 10 has been fixed to the hoistway 2 or (some other) bracket fixed on a rail line 10 e.g. for the purpose of supporting said movable machine room, or a guide rail section 11 of a guide rail line 10.

In said hoisting of the movable machine room 1 upwards to a second transport position II, the movable machine room is preferably hoisted with a hoisting arrangement 20, 21 taking support from a support structure 22 mounted in the hoistway 2 above the movable machine room 1.

Figure 11:
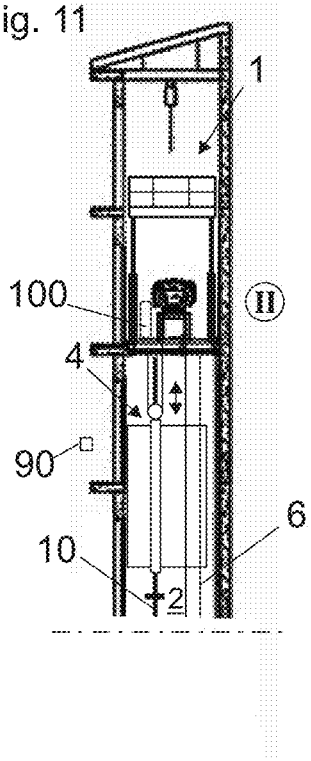

After said mounting the movable machine room 1 to the second transport position II, the method comprises using (also referred to as second using) the elevator car 4 for transporting passengers and/or goods below the movable machine room 1 while the movable machine room 1 is mounted in said second position II and while the elevator car 4 and the counterweight 5 hang suspended from the movable machine room 1 by the hoisting roping 6, as illustrated in FIG. 11.

Said second using the elevator car 4 for transporting passengers and/or goods preferably comprises receiving call signals from one or more user interfaces 90, in particular one or more user interfaces 90 located at floors and/or in the elevator car and/or mobile user interfaces, and moving the elevator car 4 in response to said call signals automatically controlled by an elevator control system 100.

Figure 12:
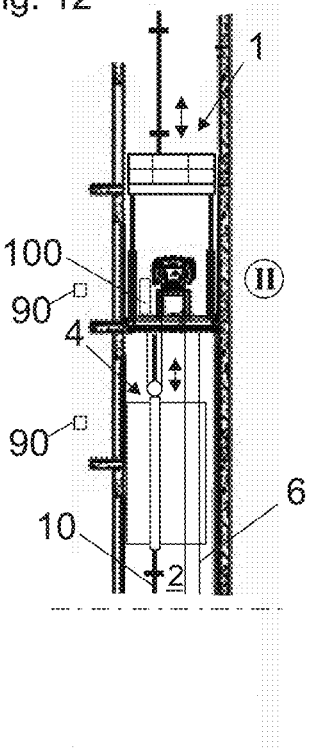

Also after said mounting the movable machine room 1 to the second transport position II, preferably at least partially during said second using, the method comprises placing a guide rail section 11 on top of an earlier fixed guide rail section 11 of a guide rail line 10 and fixing it with brackets 12 immovably into the hoistway 2, as illustrated in FIG. 12. Hereby, the guide rail line(s) 10 can be constructed to extend higher during transport use of the elevator. Said placing and fixing can be done working on top of a working platform 420 comprised in the movable machine room 1. This work may involve moving the working platform 420 up and down as will be further described later on.

Preferred, although not necessary, details of the movable machine room 1 as well as preferred, although not necessary, details of the constructing are described further hereinafter.

Preferably, said movable machine room 1 comprises a support platform 411 of a hoisting machine, the support platform comprising one or more releasable mounting mechanisms 402 installed thereon for releasably mounting the moveable machine room 1 in the hoistway 2, and a hoisting machine 14 mounted on the support platform 411; and a working platform 420 on top of the support platform 411, preferably also forming a roof of the moveable machine room 1. For enabling safe work, the working platform 420 preferably comprises handrails 421. The working platform 420 also comprises at least one support structure 430;430'; 430" supported by which the working platform 420 rests on the support platform 411. Preferably, the working platform 420 comprises at least two of said support structures 430; 430';430". Preferred parts of the movable machine room 1 appear in FIGS. 3 and 15 for instance. Basically, the support structures 430;430';430" can be positioned freely to fit layout, but preferably close to two opposite side edges of the support platform 411.

Preferably, in said constructing a movable machine room 1, the movable machine room 1 is constructed to rest supported by the floor of the hoistway 2.

Preferably, said constructing is performed from prefabricated sub-modules. In this case, said constructing a movable machine room comprises transporting into the bottom end of the hoistway 2 plurality of prefabricated sub modules 41-43 as illustrated in FIG. 2, and connecting the plurality of prefabricated sub modules 41-43 to each other in the bottom end of the hoistway 2.

Figure 16:
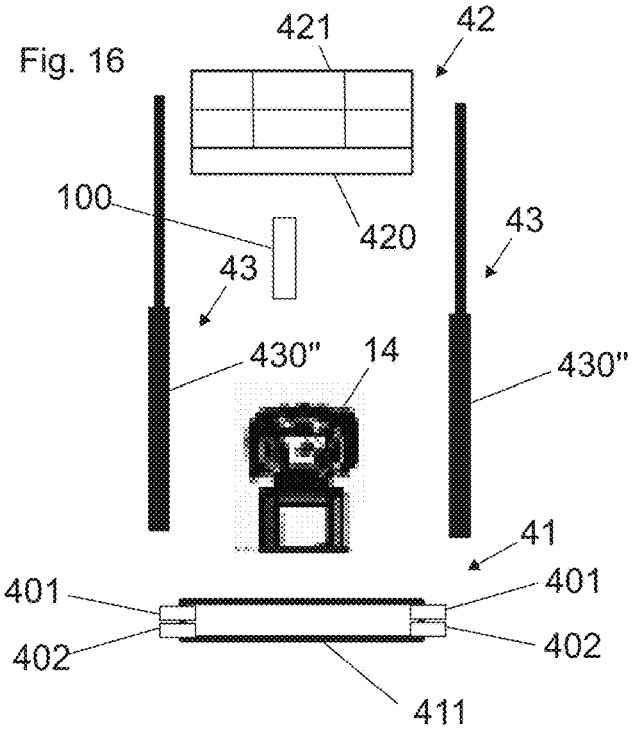
FIG. 16 illustrates preferred details of structures of the movable machine room.

Preferred details of the prefabricated sub modules 41-43 are described hereinafter referring to FIGS. 3 and 16.

Preferably, said plurality of prefabricated sub modules comprises a first prefabricated sub module 41 comprising a support platform 411 of a hoisting machine, the support platform comprising one or more releasable mounting mechanisms 402 installed thereon for mounting the moveable machine room 1 in the hoistway 2, possibly also a premounted hoisting machine.

Preferably, said plurality of prefabricated sub modules comprises a second prefabricated sub module 42 comprising a working platform 420 forming a roof of the moveable machine room 1 and comprising handrails 421.

Preferably, said plurality of prefabricated sub modules comprises at least one, but preferably two, third prefabricated sub modules 43 suitable for being mounted between the first and second module 41,42 for coupling these to each other. Preferably, said at least one third prefabricated sub module 43 comprises a support structure 430" supported by which the working platform 420 of the second prefabricated sub module 42 can rest on the support platform 411 of the first prefabricated sub module 41. Preferred alternative for the support structure 430" are illustrated later referring to FIGS. 20-23.

Preferably, the movable machine room 1, in particular the first prefabricated sub module 41 and/or the second prefabricated sub module 42, comprises a guide 401 for guiding vertical movement of the movable machine room 1 along a vertical guide rail line 10 of the elevator car 4.

When the movable machine room 1 comprises plurality of prefabricated sub modules connected to each other, the method comprises after at least once using the elevator car for transporting passengers and/or goods, disassembling the movable machine room, the disassembling preferably comprising disconnecting one or more of the sub-modules of the machine room, and constructing a movable machine room in a bottom end of another hoistway, such as a hoistway formed in a different building under construction, using parts from the disassembled machine room, preferably said one or more sub-module from the disassembled machine room. In this case, said constructing a movable machine room 1 in a bottom end of another hoistway comprises transporting into the bottom end plurality of prefabricated sub modules from the disassembled machine room, similarly as illustrated in FIG. 2. The method preferably comprises converting the construction time elevator into a permanent elevator. The conversion may comprise replacing parts of the disassembled movable machine room with parts intended to form permanent parts of the elevator under construction. Preferably, the guide rail lines 10, the car 4 and the counterweight are each at least partly left to form permanent parts of the elevator under construction in said conversion. Parts possibly replaced are roping, hoisting machine and supporting structures of the hoisting machine. Said supporting structures may include formation of a machine room floor slab and/or installation of a bed plate, for example.

Said support structure 430" is preferably selectively actuatable to expand in vertical direction for hoisting the working platform 420 higher above the support platform 411 taking reaction force from the support platform 411, or to contract in vertical direction for lowering the working platform 420 back towards the support platform 411. Said selectively actuatable means that the support structure 430 can be actuated both to expand and to contract and it can be selected which of said expanding or contracting is to be caused by the actuation.

Preferred details of the method wherein the support structure 430;430';430";430'" actuatable as above defined are described hereinafter.

As illustrated in FIGS. 9 and 12 the method comprises while the movable machine room 1 is (in a mounted state)

in a transport position (I or II) in the hoistway 2, using the working platform 420 for installing elevator components from the working platform 420 in the parts of the hoistway 2 above the support platform 411, said using comprising moving the working platform 420 up and down with said support structure 430 selectively actuatable to expand or contract.

Figure 13:
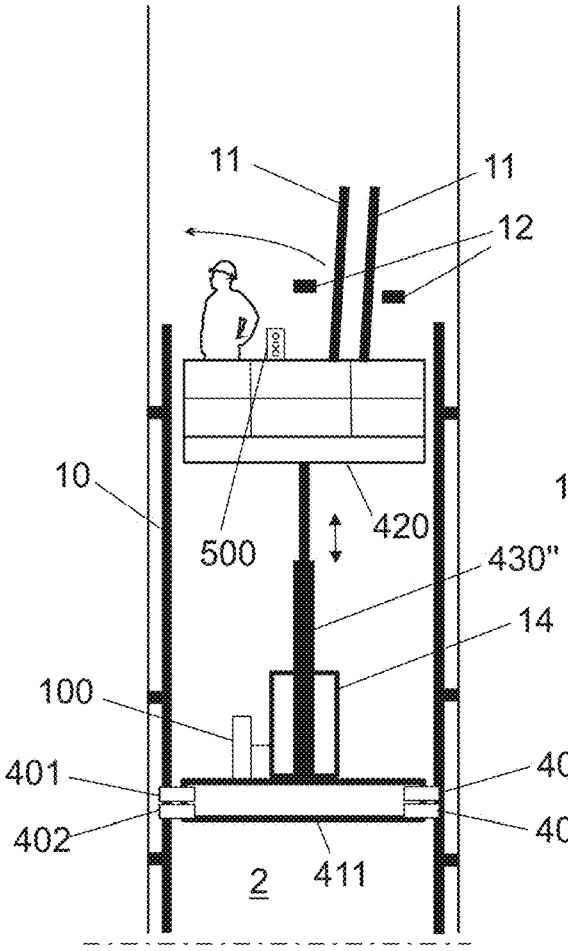
FIGS. 13 and 14 illustrate preferred details of FIGS. 9 and 12.
Figure 14:
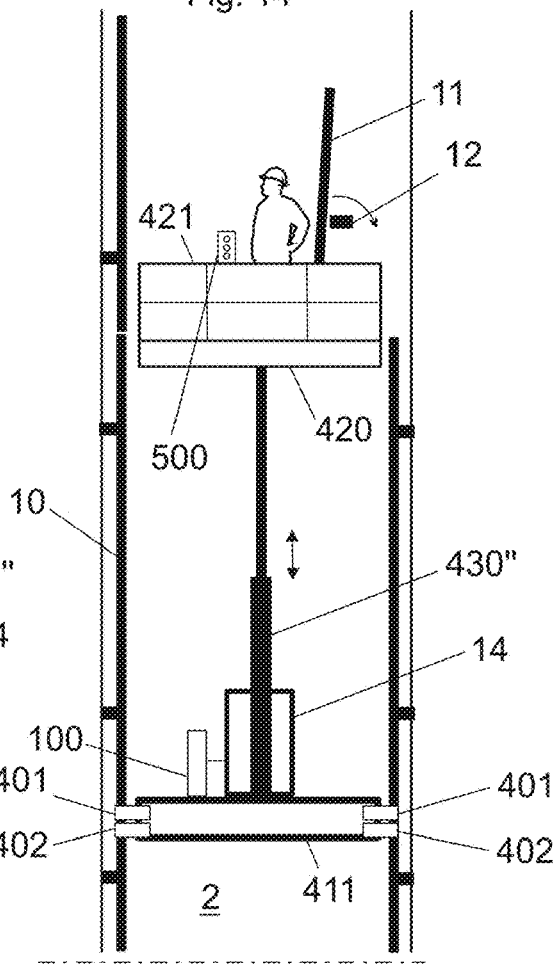

More specifically, said using comprises one or more times actuating the support structure 430 to expand in vertical direction for hoisting the working platform 420 higher above the support platform 411; and one or more times actuating the support structure 430 to contract in vertical direction for lowering the working platform 420 back towards the support platform 411. Hereby, back and forth movement is achieved and working can be performed above the support platform 411 at different heights. It is also enabled that working can be performed relatively high above the support platform 411 and thereafter the working platform 420 lowered back towards the support platform 411 so that the movable machine room 1 becomes compact and relatively easy and rigid to hoist vertically to a higher position in the hoistway 2. FIGS. 13 and 14 illustrate use of said support structure 430. The Figures illustrate a side view so as to show a pair of guide rail lines 10.

Said support structure 430 is in said actuation to expand preferably actuatable to expand from a contracted state at least 2 meters in vertical direction for hoisting the working platform 420 at least 2 meters. Hereby, the above mentioned advantages are substantially realized. The distance being substantially long, preferably at least 2 meters, preferably longer, for instance is enough in many sites to allow moving of the working platform 420 vertically to be positioned from being near to one landing to near another landing, which allows easy installation of landing door components and/or access to/from the working platform. Likewise, the distance being substantially long, preferably at least 2 meters, preferably longer, for instance is enough in many sites to allow moving of the working platform 420 vertically to be positioned from being near to one bracket position to near another bracket position, which allows easy installation and/or use of the bracket e.g. during installation of a guide rail section or the bracket itself.

Figure 10:
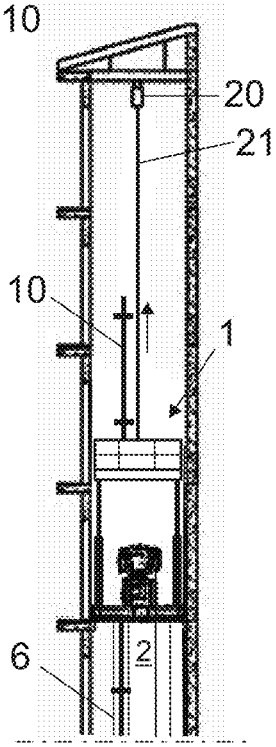

During each hoisting of the movable machine room 1 upwards to a transport position (I or II) as illustrated in FIGS. 7 and 10 for example, said support structure 430 is not actuated. Preferably, before the hoisting of the movable machine room 1 upwards to a transport position (I or II) said support structure 430 is locked from being expandable for blocking actuation thereof during said hoisting.

Generally, for enabling releasable, and thereby a temporary mounting, the movable machine room 1 comprises one or more releasable mounting mechanisms 402 for releasably mounting the movable machine room 1 vertically supported. Preferably, the releasable mounting mechanism 402 is shiftable between a first state and a second state, wherein said first state said mechanism engages a stationary structure to take support from it, the stationary structure preferably being a hoistway wall 2*a*, floor sill, a bracket by which a guide rail section 11 of a rail line 10 has been fixed to hoistway or a bracket fixed on a rail line 10 e.g. for the purpose of supporting said movable machine room, or a guide rail section 11 of a guider rail line 10, and in said second state said releasable mounting mechanism 402 is released from said engagement.

Preferred embodiments of the releasable mounting mechanism 402 are described hereinafter.

Figure 17:
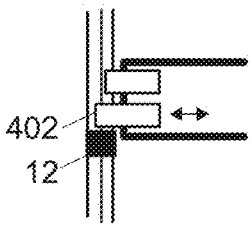
FIGS. 17-19 illustrate alternative preferred details of the releasable mounting mechanism.

In the embodiment of FIG. 17, the releasable mounting mechanism 402 comprises an arm which is movable to a first state where it vertically overlaps a bracket 12 fixed stationary in hoistway, and back to a second state where it does not overlap said bracket 12 so that it can bypass a bracket positioned above the aforementioned bracket 12 when being hoisted together with the movable machine room 1. In FIG. 17, the arm is movable between said states with a horizontal linear motion, but alternatively, it could be movable between said states with a pivoting motion.

Figure 18:
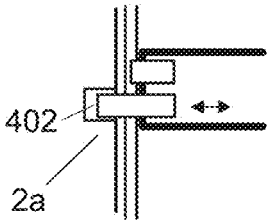

In the embodiment of FIG. 18, the releasable mounting mechanism 402 comprises an arm which is movable to be on top of a structure of the hoistway wall 2*a*, in particular on top of a surface of a pocket formed in the hoistway wall 2*a* and back away from being on top of said structure of the hoistway wall 2*a*, the first state here being a state where the arm extends to be on top of a structure of the hoistway wall 2*a*, and the second state being here a state where arm has been retracted away from being on top of said structure of the hoistway wall. In the embodiment of FIG. 18, particularly the first state is a state where the arm extends into the pocket and the second state is a state where arm is out from the pocket. Alternatively, structure of the hoistway wall 2*a* could be a beam of the hoistway wall and the surface could be an upper surface of the beam. Alternatively, the structure on top of which the arm is movable could be a floor sill, i.e. a sill of a doorway leading to a floor.

Figure 19:
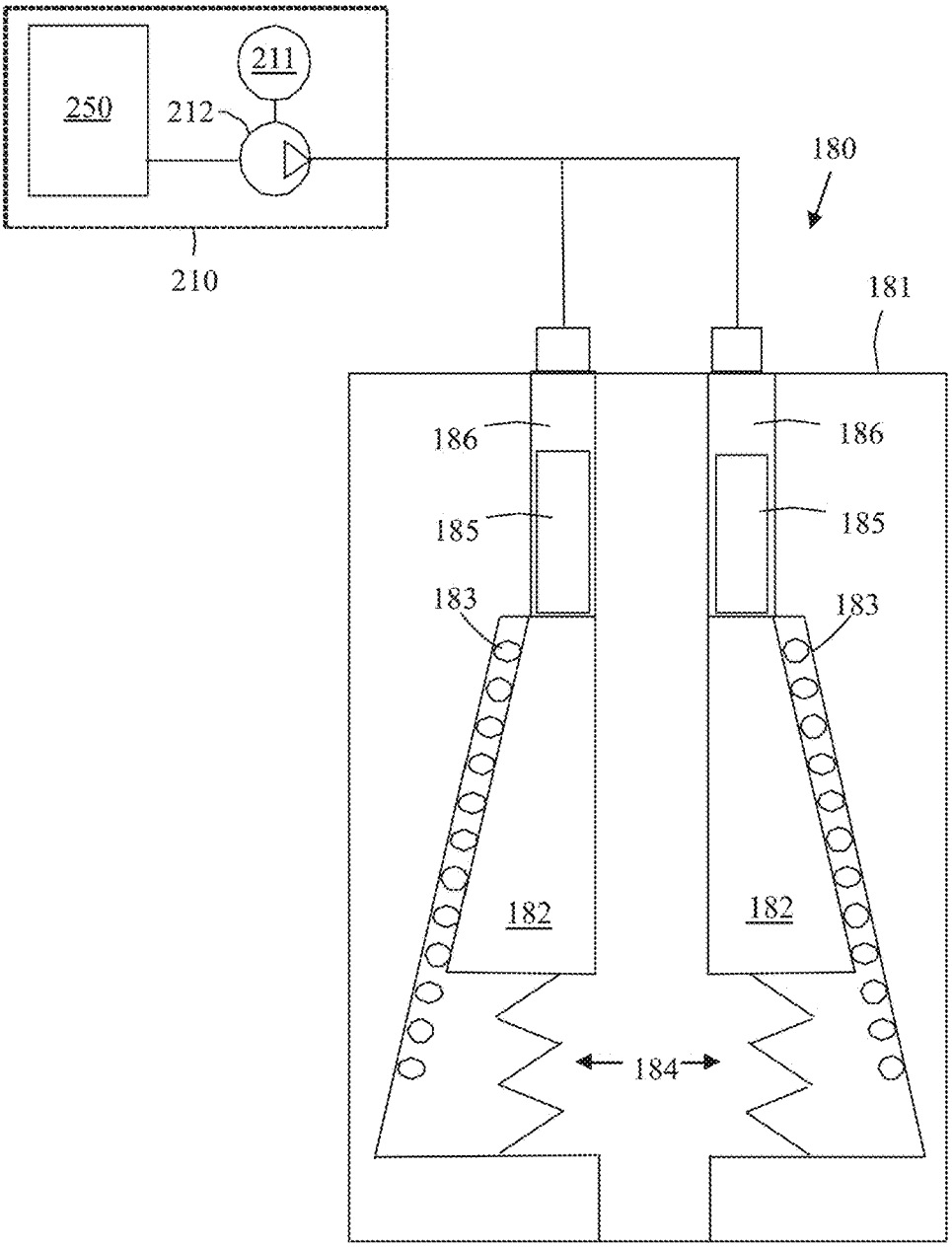

In the embodiment of FIG. 19, the releasable mounting mechanism 402 comprises a gripper 180 suitable for releasably gripping a guide rail section 11 of a guide rail line 10. In this case, the first state of the releasable mounting mechanism 402 is a state where the gripper grips a guide rail line 10 with gripping members on opposite sides of the guide rail section 11 of a guide rail 10, and the second state a state where said gripper does not grip a guide rail 10. Generally, a gripper suitable for releasably gripping a guide rail line 10 can be implemented with a wedging gripper wedging direction being downwards direction (as it is the case in the embodiment of FIG. 19) or alternatively with a fixed caliper brake or a floating caliper brake, for example. One or both of the gripping members can be movable to compress a guide rail section 11 of a guide rail line 10 between the gripping members and to release said compression. If only one of the gripping members is movable, then preferably the gripper has a frame (also known as caliper) of a floating kind in the manner known from caliper brakes. If both of the gripping members are movable, then preferably the gripper has a frame (also known as caliper) of a fixed kind in the manner known from caliper brakes. This is the case in the embodiment of FIG. 19.

The embodiment of FIG. 19 is more specifically as follows. The gripper 180 comprises a frame 181 with a slit for a guide rail line 10 and two wedge shaped brake shoes 182 as gripping members positioned on opposite sides of the guide rail line 10. The brake shoes 182 may be movably supported from the wedge surface with rollers 183 on the frame 181. A spring 184 may be positioned between a first end of the brake shoe 182 and the frame 181. A second opposite end of the brake shoe 182 may be supported on a slide 185 acting in a cylinder 186. A power unit, such as a hydraulic power unit 210 for instance, may provide power to the gripper 180. The hydraulic power unit 210 may comprise an electric motor 211, a hydraulic pump 212 and a reservoir 250. The hydraulic pump 212 pumps oil from the oil reservoir 250 to the cylinders 186 in order to move the slides 185 in the cylinders 186.

Supplying pressurized fluid to the plungers 185 in the cylinders 186 will press the brake shoes 182 downwards in the figure against the force of the springs 184. The brake shoes 182 are thus moved away from the guide surfaces of the guide rail line 10. The movable machine room 1 is thus free to move on the guide rail line(s) 10.

Extracting pressurized fluid from the cylinders 186 will allow the brake shoes 182 to move upwards in the figure due to the force caused by the springs 184 acting on the second end of the brake shoe 182. The brake shoes 182 are thus moved into contact with the guide surfaces of the guide rail line 10. The support structure 411 will thus become locked to the guide rail line 10.

The hydraulic unit 210 may be provided only for the gripper 180. Another possibility is to have a common main hydraulic unit on the working platform 420 for all equipment needing hydraulic power on the working platform 420. Hydraulic valves may be used to connect the different equipment to the common main hydraulic power unit.

The gripper 180 comprises in the embodiment of FIG. 19 two wedge shaped brake shoes 182.

The gripper 180 may as an alternative be operated electromechanically. An electromechanical device may be used to press the brake shoes 182 against the force of the springs 184. Deactivation of the electromechanical device will activate the brake shoes 182 against the guide rail line 10.

In addition to above described variations of brake construction, several other known type brake mechanics can be applied to fulfill previously mentioned overall braking/gripping function. For instance, in some elevator system a brake system is comprised where gripping to a guide rail is produced via plier type jaws and associated friction lining. This lever type brake can be used as a further alternative.

Preferred details of the support structure 430;430';430"; 430''' are described hereinafter.

FIGS. 20-23 illustrate alternative embodiments of a support structure 430 selectively actuatable to expand in vertical direction for hoisting the working platform 420 higher above the support platform 411 taking reaction force from the support structure 430, or to contract in vertical direction for lowering the working platform 420 back towards the support platform 411.

Figure 20:
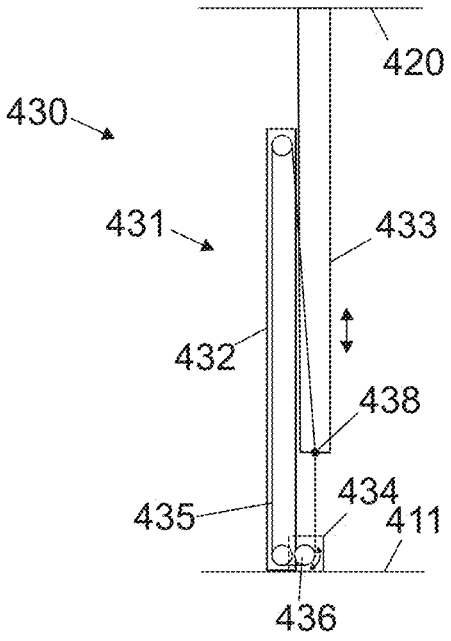
FIGS. 20-23 illustrate alternative preferred details of the support structure.

FIG. 20 illustrates schematically an embodiment, where the support structure 430 comprises an upright mast 431 selectively actuatable to expand or contract in vertical direction.

Said upright mast 431 is connected between the working platform 420 and the support structure 411. Said upright mast 431 comprises plurality of parallel elongated mast members 432,433 movable along each other. Said elongated mast members 432,433 are vertically oriented beams and the support structure comprises an actuating means 434,435 for moving them along each other for expanding the mast or contracting the mast 431. The elongated mast members 432,433 are supported against each other to be moved along each other so that one mast member guides the other, which can be implemented e.g. placing them in telescopic configuration or arranging them to have interlocking profiles moving along each other.

In the embodiment of FIG. 20, the actuating means 434;435 comprise a motor 434 arranged to rotate a drive wheel 436 around which a flexible member 435, such as a belt, passes and rotation of the wheel is arranged to move the flexible member 435. The flexible member 435 is arranged to pass over a wheel mounted in the upper end of a first mast member 432 and back downwards to a fixing point in the lower end of a second mast member 433. Thereby, rotation of the motor in one direction is arranged to pull the second mast member 433 upwards relative to the first mast member 432 and rotation of the motor in the other, i.e. opposite direction, is arranged to allow the second mast member 433 to be moved downwards relative to the first mast member 432 by gravity. The flexible member 435 passes on both sides of the drive wheel 436 to a fixing point 438 which fixing point 438 is arranged to move together with the second mast member 433 whereby flexible member 435 forms a loop and need not be reeled around the drive wheel 436. This is however another alternative way to implement the embodiment. In this case, one end of the flexible member 435 is fixed to a fixing point in the lower end of a second mast member 433 and the other end to a fixing point on the drive wheel 436.

Figure 21:
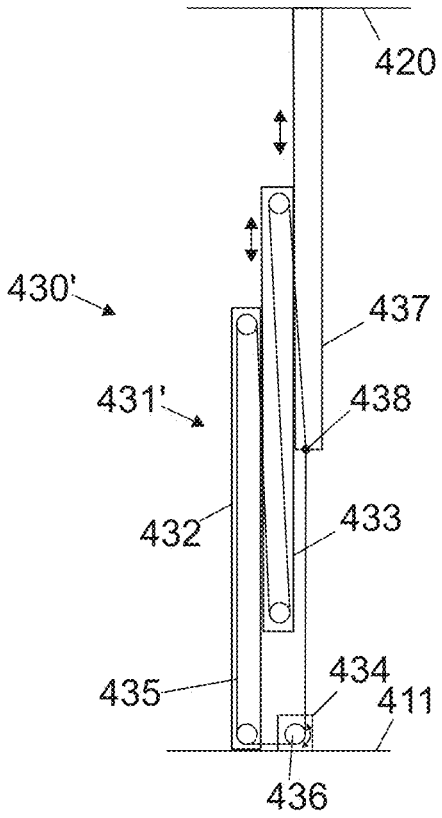

FIG. 21 illustrates schematically an embodiment, where the support structure 430' comprises an upright mast 431' selectively actuatable to expand or contract in vertical direction.

Said upright mast 431' is connected between the working platform 420 and the support structure 430. Said upright mast 431' comprises plurality of parallel elongated mast members 432,433,437 movable along each other.

Said elongated mast members 432,433,437 are vertically oriented beams and the support structure comprises an actuating means 434;435 for moving them along each other for expanding the mast or contracting the mast 431'. The elongated mast members 432,433,437 are supported against each other to be moved along each other so that one mast member guides the other, which can be implemented e.g. placing them in telescopic configuration or arranging them to have interlocking profiles moving along each other.

In the embodiment of FIG. 21, the actuating means 434,435 comprise a motor 434 arranged to rotate a drive wheel 436 around which a flexible member 435, such as a belt, passes and rotation of the wheel is arranged to move the flexible member 435. The flexible member 435 is arranged to pass over a wheel mounted in the upper end of a first mast member 432 and back downwards and to pass around and under a wheel mounted in the lower end of a second mast member 433 and again upwards over a wheel mounted in the upper end of the second mast member 433, over it and back downwards to a fixing point in the lower end of the third mast member 437. Thereby, rotation of the motor in one direction is arranged to pull the second mast member 433 upwards relative to the first mast member 432, and rotation of the motor in the other, i.e. opposite direction, is arranged to allow the second mast member 433 to be moved downwards relative to the first mast member 432 by gravity. Moreover, rotation of the motor in one direction is arranged to pull the third mast member 437 upwards relative to the second mast member 433, and rotation of the motor in the other, i.e. opposite direction, is arranged to allow the third mast member 433 to be moved downwards relative to the second mast member 433 by gravity. The flexible member 435 passes on both sides of the drive wheel 436 to a fixing point 438 which fixing point 438 is arranged to move together with the third mast member 437 whereby flexible member 435 forms a loop and need not be reeled around the drive wheel 436. This is however another alternative way to implement the embodiment. In this case, one end of the flexible member 435 is fixed to a fixing point in the lower end of a third mast member 433 and the other end to a fixing point on the drive wheel 436.

Figure 22:
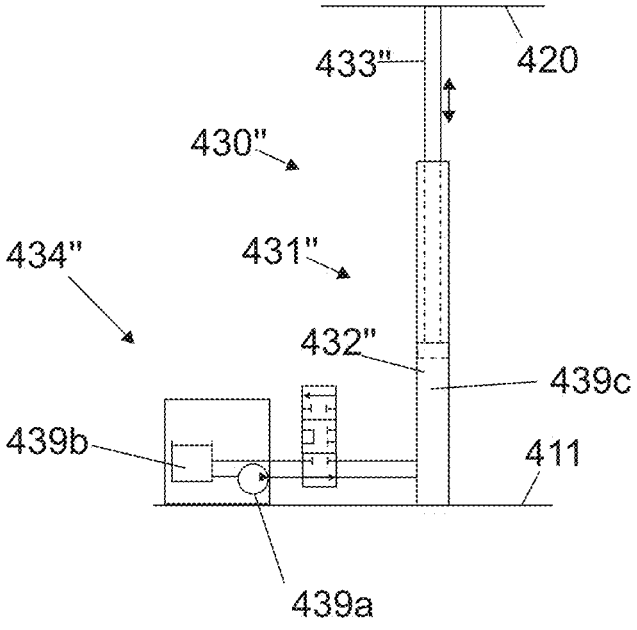

FIG. 22 illustrates schematically an embodiment, where the support structure 430" comprises an upright mast 431" selectively actuatable to expand or contract in vertical direction. Said upright mast 431" is connected between the working platform 420 and the support structure 430. Said upright mast 431" comprises plurality of parallel elongated mast members 432,433 movable along each other. Said elongated mast members 432,433 are vertically oriented hydraulic cylinder and piston, hydraulically selectively actuatable to expand or contract. The support structure comprises an actuating means 434" for moving them along each other for expanding the mast or contracting the mast 431, said actuating means comprising a hydraulic pump 439*a* and hydraulic fluid 439*b* stored in a reservoir for being pumped into a chamber 439*c* of the hydraulic cylinder.

Figure 23:
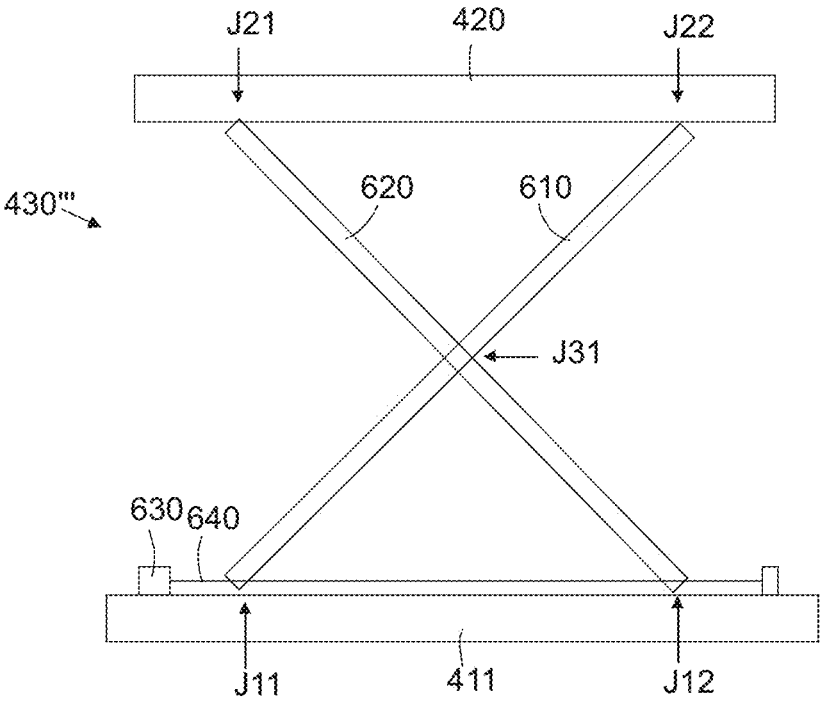

FIG. 23 illustrates schematically an embodiment, where the support structure 430"' comprises a scissor jack mechanism selectively actuatable to expand or contract in vertical direction.

In the preferred embodiment of FIG. 23, the scissor jack mechanism comprises two support arms 610, 620 connected via an articulated joint J31. The upper end of each support arm 610, 620 is connected via articulated joint J21, J22 with the working platform 420. The lower end of each support arm 610, 620 is connected via an articulated joint J11, J12 with the support platform 411.

Each of the articulated joints J11, J12 at the lower deck 110 and each of the articulated joints J21, J22 at the upper deck 120 should be arranged so that movement of the ends of the support arms 610, 620 relative to each other in the horizontal direction is allowed, but movement of the ends of the support arms 610, 620 relative to each other in the vertical direction is prevented.

An actuating means 630, in particular an actuator 630 is arranged to actuate the scissor jack mechanism to selectively expand or contract in vertical direction. The actuator 630 may be connected to a rod 640 passing in a horizontal and mounted on the support platform 411 or on a pedestal or equivalent mounted thereon. The rod 640 may be formed as a worm screw. The lower end of the first support arm 610 could be attached via a shaft 640 to an actuator 630. The lower end of the first support arm 610 may be provided with articulated joint cooperating with the worm screw 640. The worm screw 640 may be attached via joint parts to the lower end portions of the support arms 610, 620. The outer ends of the worm screw 640 may be supported on the support platform 411. Rotation of the actuator 630 in a first direction will move the lower ends of the support arms 610, 620 towards each other, whereby the support platform 411 and working platform 420 are moved in a direction away from each other. Rotation of the actuator 630 in a second opposite direction will move the lower ends of the support arms 610, 620 away from each other, whereby the support platform 411 and working platform 420 are moved in a direction towards each other. The working platform 420 may thus be lifted or lowered relative to the support platform 411 selectively with the actuator 630. The actuator 630 may be formed of a motor, e.g. an electric motor rotating the worm screw 640. A pair of scissor jacks mechanism 600 may be used i.e. one articulated jack 600 may be positioned at each side edge of the support platform 411 and working platform 420. As an alternative to the worm screw, the actuator 630 of the scissor jack mechanism 600 could be a hydraulic cylinder-piston actuator.

The cylinder-piston actuator could then extend between the support platform 411 and an upper portion of either support arm 610, 620, for example. The scissor jack mechanism 600 could also comprise several layers of crosswise running support arms stacked upon each other. As a yet one more alternative, the hydraulic cylinder-piston actuator could be arranged horizontally to selectively push and pull one of the ends of the support arms 610, 620 along a guide rail.

Generally, regarding the actuation, also gravity can be utilized to cause or aid the contraction. The actuation to retract does not necessitate actually producing movement with the actuating means 434,435;434',435';434";630, such as rotation of a motor or shortening of a mast or contraction movement of a scissor jack mechanism for example. This is because for example mere shifting of the actuating means 434,435;434',435';434"; 630 to free run or to braking mode could be utilized. For example, in the embodiments of FIGS. 19 and 20, the motor 434 could be shifted to free rotation or to produce a moment for braking the rotation caused by gravity so as to control the contraction. Likewise, for example in the embodiment of FIG. 21 the actuation to contract could include shifting the hydraulic circuit to cause pressure release in the chamber 439*c*, preferably in a controlled manner to maintain pressure for braking the contraction of the hydraulic cylinder caused by gravity so as to control the contraction. Likewise, for example in the embodiment of FIG. 22 the actuation to contract could include the actuator 630 could be shifted to free rotation or to produce a moment for braking the rotation caused by gravity so as to control the contraction.

Figure 24:
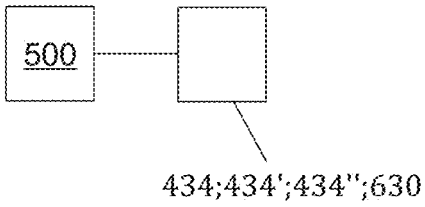
FIG. 24 illustrates an operating interface.

Preferably, an operating interface 500 is connected, e.g. with wired or wireless connection, to each selectively actuatable support structure of the movable machine room, in particular to the actuating means 434,435;434',435';434"; 630 of each selectively actuatable support structure of the movable machine room 1, as illustrated in FIG. 24. The operating interface 500 is preferably manually operable by a person. The operating interface 500 can be in the form of an operating panel such as a push button panel or a touch screen, for instance. The aforementioned using the working platform preferably comprises operating the operating interface 500. The operating interface 500 in the form of an operating panel can for example comprise a mobile device such as a mobile phone or a tablet for instance, wherein a software an application suitable for receiving user commands, is installed and/or running.

Generally, some advantages of the method can be achieved even though some detail are different than shown in the illustrated and described examples. For example many advantages of modularity and/or the order in which the movable machine room, can and counterweight are provided into the hoistway and moved therein, can be achieved also even though the hoisting of the machine room is different. For example, advantages are achievable also if the at least one selectively actuatable support structure would be used for making the movable machine room able to climb in the hoistway.

Generally preferably, the working platform 420 is at least 1.5 meters, preferably at least 1.8 meters above the support platform 411, whereby a substantial space for working and/or safely dwelling between them is provided. This is the case preferably at all times. Accordingly, preferably when said at least one support structure 430;430';430";430"' is in contracted state in a case where said at least one support structure 430;430';430";430"' is selectively actuatable to expand or contract.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A method for constructing an elevator comprising constructing a movable machine room in a bottom end of a hoistway formed in a building under construction, wherein the constructing includes placing a first submodule including a support platform into the bottom end of the hoistway, assembling a second submodule including a vertically extendable support structure to the support platform and assembling a third submodule including a working platform to the vertically extendable support structure; and thereafter hoisting the movable machine room; and constructing an elevator car in the bottom end of the hoistway below the movable machine room; and providing a counterweight in the bottom end of the hoistway below the movable machine room;

connecting the elevator car and the counterweight with a suspension roping; and thereafter hoisting the movable machine room to a first transport position; and thereafter mounting the movable machine room to the first transport position in the hoistway vertically supported on stationary structures; and thereafter using the elevator car for transporting passengers and/or goods below the movable machine room while the movable machine room is mounted in said first transport position; and thereafter hoisting the movable machine room upwards to a second transport position; wherein the second transport position is higher than said first transport position; and thereafter mounting the movable machine room to the second transport position in the hoistway vertically supported on stationary structures; and thereafter using the elevator car for transporting passengers and/or goods below the movable machine room while the movable machine room is mounted in said second position.

2. A method according to claim 1, wherein in said constructing a movable machine room, the movable machine room is constructed in the bottom end of a hoistway to rest supported by the floor of the hoistway.

3. A method according to claim 1, wherein in said constructing an elevator car the elevator car is constructed above a buffer; and/or the elevator car is constructed to lean laterally on one or more guide rail lines; and/or structural parts of the elevator car are installed on a car frame while it is suspended from the machine room by an auxiliary hoist.

4. A method according to claim 1, wherein the method comprises after using the elevator car for transporting passengers and/or goods, disassembling the movable machine room, the disassembling preferably comprising disconnecting one or more of the sub-modules of the machine room, and constructing a movable machine room in a bottom end of another hoistway.

5. A method according to claim 1, wherein the support platform includes one or more releasable mounting mechanisms for releasably mounting the moveable machine room in the hoistway, and a hoisting machine mounted on the support platform.

6. A method according to claim 1, wherein the method comprises, while the movable machine room is in a transport position in the hoistway, using the working platform for installing elevator components from the working platform in the parts of the hoistway above the support platform, said using comprising moving the working platform up and down with the vertically extendable support structure.

7. A method according to claim 6, wherein said using comprises one or more times actuating the vertically extendable support structure to expand in vertical direction for hoisting the working platform higher above the support platform; and one or more times actuating the vertically extendable support structure to contract in vertical direction for lowering the working platform back towards the support platform.

8. A method according to claim 1, wherein said vertically extendable support structure comprises an upright mast selectively actuatable to expand or contract in a vertical direction.

9. A method according to claim 1, wherein said vertically extendable support structure comprises a scissor jack mechanism selectively actuatable to expand or contract in vertical direction.

10. A method according to claim 1, wherein said support platform comprising one or more releasable mounting mechanisms installed thereon for releasably mounting the moveable machine room in the hoistway.

11. A method according to claim 10, further comprising a guide for guiding vertical movement of the movable machine room along a vertical guide rail line of the elevator car.

12. A method according to claim 1, wherein the method comprises mounting vertical guide rail lines in the hoistway for guiding movement of the elevator car and/or the movable machine room.

13. A method according to claim 1, wherein in said hoisting of the movable machine room, the movable machine room is hoisted with a hoisting arrangement taking support from a support structure mounted in the hoistway above the movable machine room.

14. A method according to claim 1, wherein each said using elevator car for transporting passengers and/or goods comprises receiving call signals from one or more user interfaces, and moving the elevator car in response to said call signals automatically controlled by an elevator control system.

15. A method according to claim 1, wherein each said mounting of the movable machine room is performed with at least one releasable mounting mechanism.

* * * * *